US010396511B2

(12) United States Patent
Liu et al.

(10) Patent No.: US 10,396,511 B2
(45) Date of Patent: Aug. 27, 2019

(54) CORRUGATED CABLE CO-AXIAL CONNECTOR

(71) Applicant: CommScope Technologies LLC, Hickory, NC (US)

(72) Inventors: Jin Liu, Suzhou (CN); JianPing Wu, Suzhou (CN); Yujun Zhang, Suzhou (CN)

(73) Assignee: CommScope Technologies LLC, Hickory, NC (US)

( * ) Notice: Subject to any disclaimer, the term of this patent is extended or adjusted under 35 U.S.C. 154(b) by 0 days.

(21) Appl. No.: 15/891,659

(22) Filed: Feb. 8, 2018

(65) Prior Publication Data

US 2018/0261962 A1 Sep. 13, 2018

(30) Foreign Application Priority Data

Mar. 8, 2017 (CN) ..... 2017 1 0135453

(51) Int. Cl.

| | |
|---|---|
| ***H01R 9/05*** | (2006.01) |
| ***H01R 24/56*** | (2011.01) |
| *H01R 103/00* | (2006.01) |

(52) U.S. Cl.

CPC ..... *H01R 24/564* (2013.01); *H01R 9/0524* (2013.01); *H01R 9/0521* (2013.01); *H01R 2103/00* (2013.01)

(58) Field of Classification Search

CPC ..... H01R 27/00; H01R 13/436; G01N 33/92; G01N 33/5088; G01N 33/5091;

(Continued)

(56) References Cited

U.S. PATENT DOCUMENTS 5,167,533 A * 12/1992 Rauwolf ..... H01R 9/0521 439/583
6,109,964 A * 8/2000 Kooiman ..... H01R 24/564 439/578

(Continued)

FOREIGN PATENT DOCUMENTS

CN 1604395 A 4/2005
CN 101262109 9/2008

OTHER PUBLICATIONS

Notification of Transmittal of the International Search Report and the Written Opinion of the International Searching Authority, or the Declaration corresponding to International Application No. PCT/US2018/017917 dated May 28, 2018.

*Primary Examiner* — Truc T Nguyen
(74) *Attorney, Agent, or Firm* — Myers Bigel, P.A.

(57) ABSTRACT

The corrugated cable co-axial connector includes a connection body (1), having an internal thread (12) in a connector through hole (11); a clamping nut (2), having a central through hole (21), having a cable end and a clamping end in an axial direction of the central through hole (21) which are opposite to each other, and having an external thread (22) at the clamping end; an annular elastic clip (3) which is axially slidingly fitted into the central through hole (21) of the clamping nut (2); and a resilient ring (4) sleeved around the annular elastic clip (3) and located between the clamping end of the clamping nut (2) and the annular elastic clip (3). When a corrugated cable (10) having a corrugated outer conductor (102) is received in the central through hole (21) of the clamping nut (2), the connector body (1) applies at least a radial inward force to the annular elastic clip (3) by the engagement of the external thread (22) and the internal thread (12), to lock the corrugated cable (10) in the annular elastic clip (3). The connector is simple to manufacture and (Continued)

is convenient to use. At the same time, it is able to ensure the reliable cable connection and is suitable for repeated use.

16 Claims, 4 Drawing Sheets

(58) Field of Classification Search
CPC ..... G01N 2800/305; G01N 2800/30; G01N 2405/08; G01N 2800/50
See application file for complete search history.

(56) References Cited

U.S. PATENT DOCUMENTS

| | | | | |
|---|---|---|---|---|
| 6,267,621 | B1 * | 7/2001 | Pitschi | H01R 24/564 439/578 |
| 6,639,146 | B1 | 10/2003 | Chiu | |
| 6,716,061 | B2 * | 4/2004 | Pitschi | H01R 24/564 333/260 |
| 7,934,954 | B1 * | 5/2011 | Chawgo | H01R 9/0524 439/578 |
| 2002/0013088 | A1 * | 1/2002 | Rodrigues | H01R 9/0521 439/578 |
| 2003/0119358 | A1 | 6/2003 | Henningsen | |
| 2005/0164552 | A1 | 7/2005 | Wlos et al. | |
| 2005/0170693 | A1 * | 8/2005 | Wild | H01R 9/0521 439/578 |
| 2006/0003563 | A1 * | 1/2006 | Buenz | H01R 9/0521 438/583 |
| 2008/0045081 | A1 * | 2/2008 | Studerus | H01R 13/5205 439/578 |
| 2008/0194142 | A1 | 8/2008 | Wlos | |
| 2008/0274643 | A1 * | 11/2008 | Chawgo | H01R 9/0524 439/583 |
| 2010/0081321 | A1 * | 4/2010 | Malloy | H01R 13/187 439/578 |
| 2010/0112855 | A1 * | 5/2010 | Paynter | H01R 9/0521 439/584 |
| 2010/0261382 | A1 * | 10/2010 | Montena | H01R 9/0524 439/584 |
| 2011/0003507 | A1 * | 1/2011 | Van Swearingen | B29C 45/16 439/578 |
| 2011/0021074 | A1 * | 1/2011 | Paynter | H01R 9/0521 439/584 |
| 2011/0312211 | A1 * | 12/2011 | Natoli | H01R 9/05 439/460 |
| 2012/0077368 | A1 | 3/2012 | Proeckl | |
| 2012/0270438 | A1 * | 10/2012 | Natoli | H01R 13/02 439/578 |
| 2014/0045357 | A1 * | 2/2014 | Nugent | H01R 13/5221 439/275 |
| 2015/0236458 | A1 * | 8/2015 | Zimmerhaeckel | H01R 24/545 439/582 |

* cited by examiner

CORRUGATED CABLE CO-AXIAL CONNECTOR

RELATED APPLICATION

This application claims priority from Chinese Application No. 201710135453.9 filed Mar. 8, 2017, the disclosure of which is hereby incorporated herein in its entirety.

FIELD OF THE INVENTION

Embodiments of the present invention relate to a corrugated cable co-axial connector, and in particular to a radio frequency device connector for an annular corrugated outer conductor cable.

BACKGROUND OF THE INVENTION

A radio frequency device connector (also referred to as a radio frequency connector) for annular corrugated outer conductor cables is an electromechanical assembly which connects a conductor (wire) with a suitable mating device to turn on and turn off microwave signals. In existing communication products, the radio frequency signal transmission between the commonly used radio remote unit (Radio Remote Unit, RRU) and a smart antenna is typically achieved with a ½ radio frequency co-axial cable in general, with co-axial radio frequency connectors installed on two ends of the cable for connection. In order to be successfully installed on the scene, a connector which can be installed quickly is needed, while stable passive intermodulation (PIM) performance is also needed.

A typical radio frequency connector for annular corrugated outer conductor cables mainly employs two cable mounting structures. The first type is an elastic claw structure such as a connector elastic claw structure shown in Patent Publication No. CN101262109A. The complete elastic claw is telescopically connected to the cable segment of the main body through threads, and a trough location of a corrugation of the annular corrugated cable is clamped by the claw at the front end of the elastic claw. The second type is a structure adopting a spring ring, for example, a co-axial connector disclosed in Patent Publication No. CN1604395A, in which the spring ring resides in the trough area of the annular corrugated cable. The spring ring deforms under the action of the clamping nut to generate pressure so as to lock the cable to the connector.

In actual use, the elasticity of the connector adopting the elastic claw structure is decreased after the connector is installed multiple times due to the fatigue of the material (brass or composite plastic material) of the elastic claw, such that the retaining force and the passive intermodulation performance of the cable may be reduced. During the use of the connector adopting the spring ring structure, onsite installation is inconvenient, as the cable needs to be installed on the connector by using a special torque wrench. In addition, when the connector is repeatedly disconnected, the spring ring is damaged easily, and may even fall off.

SUMMARY OF THE INVENTION

In view of the above reasons, embodiments of the present invention provide a corrugated cable co-axial connector for solving at least a part of the problems existing in the above-mentioned existing connectors.

According to embodiments of the present invention, a corrugated cable co-axial connector is provided, including:

a connector body having a connector through hole, having an interface end and a matching end in an axial direction of the connector through hole which are opposite to each other, and having an internal thread at the matching end; a clamping nut having a central through hole, having a cable end and a clamping end in an axial direction of the central through hole which are opposite to each other, and having an external thread at the clamping end; an annular elastic clip which is, at the clamping end of the clamping nut, axially and slidingly fitted into the central through hole of the clamping nut; and an elastic ring sleeved around the annular elastic clip and located between the clamping end of the clamping nut and the annular elastic, clip. The clamping nut is configured such that, when a corrugated cable having a corrugated outer conductor is received in the central through hole of the clamping nut, the connector body applies at least a radial inward force to the annular elastic clip by the engagement of the external thread of the clamping nut and the internal thread of the connector body, so as to lock the corrugated cable in the annular elastic clip.

According to embodiments of the present invention, the elastic ring is configured in a way that, when the clamping nut is tightly locked with the connector body with the thread fit, the elastic ring applies at least an axial pre-tightening force to the clamping nut.

According to embodiments of the present invention, the elastic ring is configured to further apply a radial pre-tightening force to the annular elastic clip.

According to embodiments of the present invention, the elastic ring is a spiral spring ring or an annular spring gasket.

According to embodiments of the present invention, a locking wall is formed in an inner wall of the connector through hole of the connector body. The annular elastic clip includes a plurality of claws distributed around its central axis, wherein each of the plurality of claws includes a locking portion and an extension portion, the extension portions of the plurality of claws are connected to one another at one end, and the other ends of respective extension portions form the locking portions separated from one another. An outer diameter of a ring formed by an outer circumferential wall of the locking portions of the plurality of claws is greater than a diameter of the locking wall in the connector body, so that when the clamping nut is tightly locked with the connector body with the thread fit, the locking portions of the plurality of claws are in interference-fit with the locking wall in the connector body and are forced to generate a radial inward elastic deformation.

According to embodiments of the present invention, on an inner wall of the connector through hole of the connector body is provided a transition slope between the internal thread and the locking wall, and a guide slope is arranged between an outer end face of the locking portion of the plurality of claws and the outer circumferential wall of the locking portion of the plurality of claws. The guide slope is adapted to fitting with the transition slope to guide the locking portion to be in interference fit with the locking wall.

According to embodiments of the present invention, the elastic ring is sleeved around the extension portion of the claw of the annular elastic clip, and is located between the clamping end of the clamping nut and the locking portion of the claw.

According to embodiments of the present invention, the extension portion of the plurality of claws slidingly extends from the clamping end of the clamping nut into the central through hole of the clamping nut, and an inner diameter of a ring formed by the extension portions of the plurality of claws is configured to allow the corrugated outer conductor of the corrugated cable to extend into the ring formed by the extension portions. An inner diameter of a ring formed by an inner circumferential wall of the locking portion is smaller than an inner diameter of the ring formed by the extension portions, so that the inner circumferential wall of the locking portion is adapted to fitting with a valley of the corrugated outer conductor of the corrugated cable.

According to embodiments of the present invention, a locking slope is formed between the outer end face of the locking portion of the plurality of claws and the inner circumferential wall of the looking portion of the plurality of claws, and a supporting slope is formed in the connector body. When the clamping nut is locked with the connector body with a threaded fit, a distal end of the corrugated outer conductor of the corrugated cable extending into the annular elastic clip is clamped between the locking slope and the supporting slope.

According to embodiments of the present invention, a snap is arranged at an end of the annular elastic clip opposite to the locking portion, a flange is formed on an inner wall of the clamping end of the clamping nut, and the snap is adapted to be pressed by the flange to elastically deform to slide into the central through hole of the clamping nut.

According to embodiments of the present invention, an elastic clip external thread is arranged at an end of the annular elastic clip opposite the locking portion, and a clamping nut internal thread is formed on an inner wall of the clamping end of the clamping nut. The elastic clip external thread is configured such that by continuing to rotate the elastic clip external thread after the elastic clip external thread is threaded into the clamping nut internal thread, the elastic clip external thread disengages with the clamping nut internal thread to slide into the central through hole of the clamping nut.

According to embodiments of the present invention, the annular elastic clip is made of hard plastic or brass material.

According to embodiments of the present invention, an interface end of the connector body has a connecting nut to lock the connector body to an external port.

According to embodiments of the present invention, the connector through hole of the connector body is configured to allow an inner conductor of the corrugated cable to extend in the connector through hole to the interface end.

In the corrugated cable co-axial connector according to embodiments of the present invention, the annular elastic clip is driven by the threaded connection to generate radial elastic deformation to lock the corrugated cable, so that the radial clamping force of the annular elastic clip mainly comes from the interference fit between the connector body and the annular elastic clip rather than the elasticity of the annular elastic clip, which ensures that even if the elasticity of the annular elastic clip is reduced by repeated assembly and disassembly of the connector, sufficient radial clamping force can still be applied to the annular elastic clip via the threaded connection to reliably lock the corrugated cable. Therefore, the corrugated cable co-axial connector according to embodiments of the present invention is suitable for repeated use.

In the corrugated cable, co-axial connector according to embodiments of the present invention, the elastic clip structure is combined with the elastic ring structure, and the axial pre-tightening force is applied to the clamping nut by the elastic ring, so that the thread locking between the clamping nut and the connector body is unlikely to become loose. Therefore, the connector body can reliably provide the radial clamping force to the annular elastic clip to ensure a reliable connection between the connector and the corrugated cable.

The elastic ring in the corrugated cable co-axial connector according to embodiments of the present invention can be easily sleeved on the annular elastic clip, and the annular elastic clip, the elastic ring and the clamping nut are adapted to being connected together to be provided to a user as a complete assembly, so that the user can install the elastic ring on the connector without wasting labor, and the corrugated cable can be connected to the connector just by the simple thread fit between the connector body and the clamping nut. Therefore, the corrugated cable co-axial connector according to the embodiments of the present invention is simple to manufacture and is convenient to use.

BRIEF DESCRIPTION OF THE DRAWINGS

These and other objectives, features and advantages will become more apparent as the following detailed description of the exemplary embodiments is read in conjunction with the drawings, in which.

DETAILED DESCRIPTION OF THE EMBODIMENTS

Various embodiments of the present invention will now be described in detail by way of example only.

Figure 1:
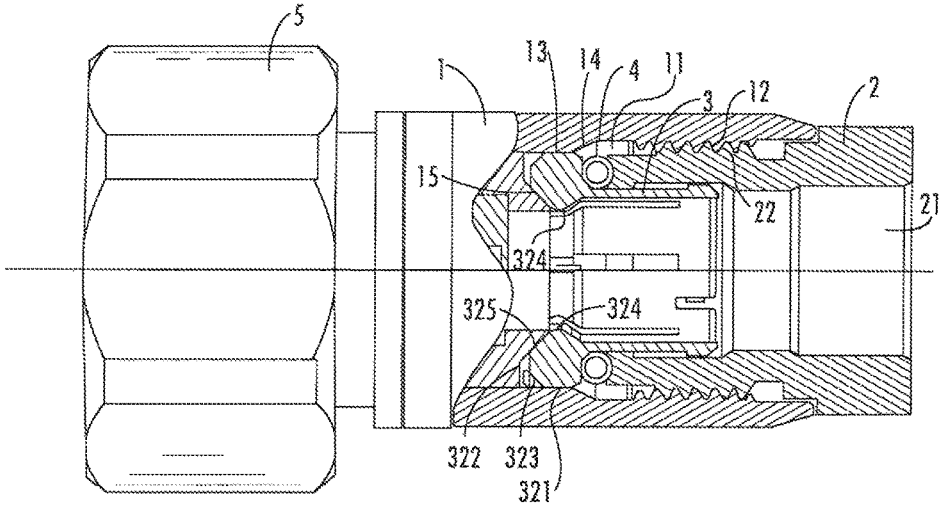
FIG. 1 is a section view of a corrugated cable co-axial connector according to an embodiment of the present invention.
Figure 2:
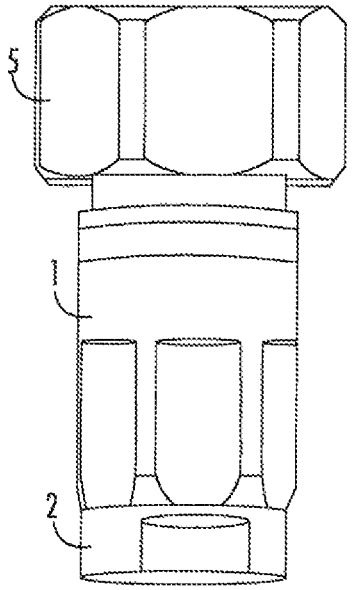
FIG. 2 is a top view of the corrugated cable co-axial connector of FIG. 1.

Referring to FIG. 1 and FIG. 2, show a section view of a corrugated cable co-axial connector according to an embodiment of the present invention. The corrugated cable co-axial connector includes: a connector body 1 having a connector through hole 11, and having an interface end and a matching end in an axial direction of the connector through hole 11 which are opposite each other. The connector through hole 11 of the connector body 1 penetrates through the whole connector body 1 to at least allow an inner conductor 101 of a corrugated cable 10 to extend in the connector through hole 11 to an interface end. The connector body 1 has an internal thread 12 at the matching end, and an interface structure is arranged at the interface end of the connector body 1 to lock the connector body 1 to an external port. For example, the interface structure is a connecting nut 5 as shown in FIG. 1.

A locking wall 13 is formed in an inner wall of the connector through hole 11 of the connector body 1 at a position closer to the interface end than the internal thread 12. The inner diameter of the locking wall 13 is smaller than the inner diameter of the internal thread 12. A transition slope 14 is further arranged on an inner wall of the connector through hole 11 between the internal thread 12 and the locking wall 13, so that the connector through hole 11 smoothly transitions from the segment of the internal thread 12 having the greater inner diameter to the segment of the locking wall 13 having the smaller inner diameter.

Optionally, in one embodiment, a supporting slope 15, which extends obliquely towards the matching end of the connector body 1 and towards the central axis of the connector body 1, is formed in the position closer to the interface end than the locking wall 13 in the connector through hole 11 of the connector body 1. The supporting slope 15 can be formed around the circumferential direction of the entire connector through hole 11 and can also be formed on several positions separately on the circumferential direction of the whole connector through hole 11 only. The function of the supporting slope 15 will be described below.

The corrugated cable co-axial connector further includes: a clamping nut 2 having a central through hole 21, having a cable end and a clamping end in an axial direction of the central through hole 21 which are opposite each other, and further having an external thread 22 at the clamping end. The external thread 22 is adapted to fit with the internal thread 12 on the connector body 1 to screw the clamping end of the clamping nut 2 into the connector through hole 11 of the connector body 1 and fixedly connect the clamping nut 2 with the connector body 1.

Figure 3:
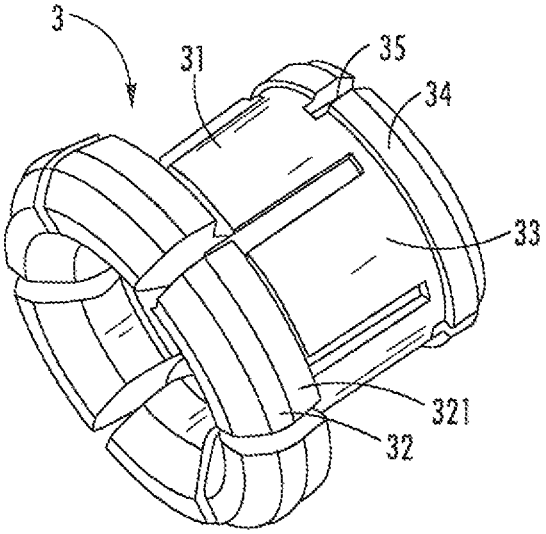
FIG. 3 is a perspective view of an annular elastic clip in the corrugated cable co-axial connector of FIG. 1.

The corrugated cable co-axial connector further includes: an annular elastic clip 3 (FIG. 3). The annular elastic clip 3 includes a plurality of claws 31 distributed around its central axis. Each of the plurality of claws 31 includes a locking portion 32 and an extension portion 33; the extension portions 33 of the plurality of claws 31 are connected to one another at one end, and the other ends of respective extension portions 33 form the locking portions 32 separated from one another. That is, open slots are formed among the adjacent extension portions 33 and the locking portions 32 on the circumferential direction of the annular elastic clip 3, so that each claw 31 has a certain elastic deformation capability, and thus the locking portion 32 at the tail end of the extension portion 33 can move on the radial direction of the annular elastic clip 3 relative to the other mutually connected end of the plurality of extension portions 33. An inner diameter of a ring formed by the extension portions 33 of the plurality of claws 31 allows the corrugated outer conductor of the corrugated cable connected to the connector to extend into the ring formed by the extension portions 33.

In order that the claws 31 of the annular elastic clip 3 have sufficient elastic deformation ability to clamp the cable, the annular elastic clip 3 can be made of hard plastic (for example, vinyl or polypropylene plastic) or a brass material and other materials with elasticity.

Figure 4:
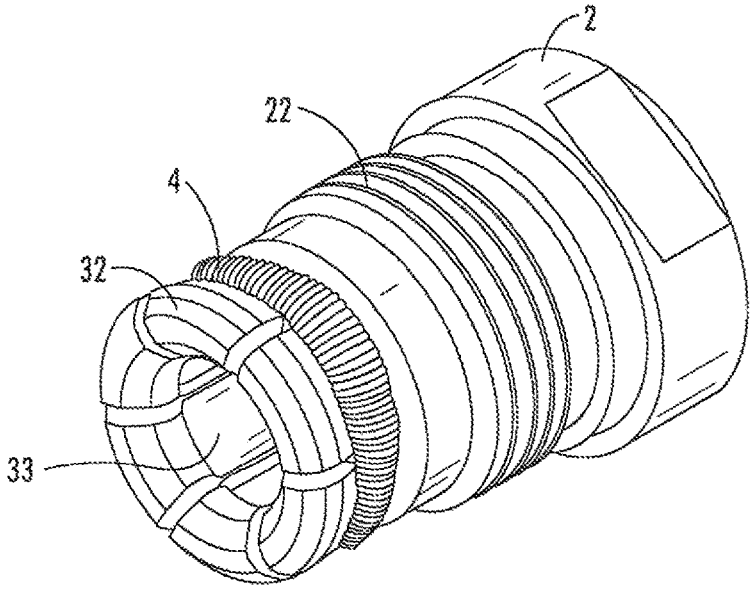
FIG. 4 is a perspective view of an assembly assembled by the annular elastic clip, a clamping nut and an elastic ring in the corrugated cable co-axial connector of FIG. 1.
Figure 5:
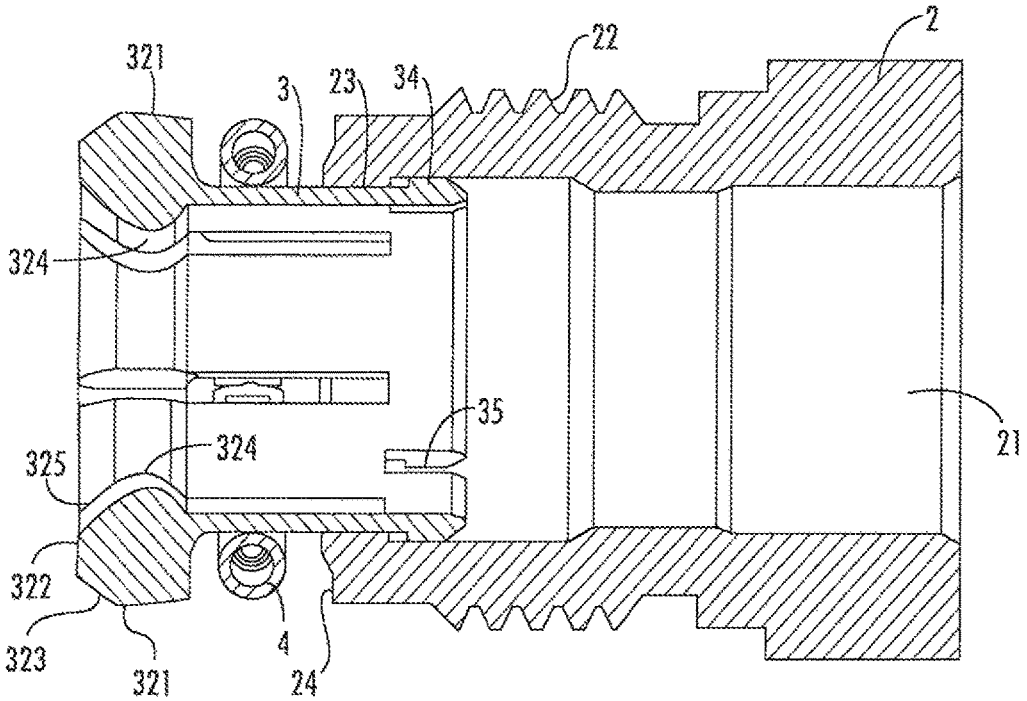
FIG. 5 is a section view of the assembly of FIG. 4.

As shown, in FIG. 3-FIG. 5, the locking portion 32 protrudes radially outward relative to the corresponding extension portion 33 to form an outer circumferential wall 321. The outer diameter of a ring formed by the outer circumferential walls 321 of the locking portions 32 is greater than the diameter of the locking wall 13 in the connector body 1, but is smaller than the inner diameter of the internal thread 12 of the connector body 1 so as to smoothly enter the connector through hole 11 in the connector body 1. A guide slope 323 is arranged between an outer end face 322 of the locking portion 32 of each claw 31 and the outer circumferential wall 321 of the locking portion 32 to fit with the transition slope 14 on the inner wall of the connector through hole 11 so, as to guide the locking portion 32 to be in interference fit with the locking wall 13 gradually. When the locking portion 32 is in interference fit with the locking wall 13, the locking portion 32 is forced to generate radial inward elastic deformation.

The locking portion 32 also protrudes radially inward relative to the corresponding extension, portion 33 to form an inner circumferential wall 324. The inner diameter of the ring formed by the inner circumferential walls 324 of the locking portions 32 is smaller than the inner diameter of the ring formed by the extension portions 33, so that the inner circumferential wall 324 of the locking portion 32 is adapted to fit with the valley of the corrugated outer conductor of the corrugated cable, which extends into the channel surrounded by the claws 31 of the annular elastic clip 3. The inner circumferential wall 324 of the locking portion 32 can have an axial section shape that is approximately matched with the shape of the valley of the corrugated outer conductor of the corrugated cable connected to the connector; for example, it may have a curved section similar to the shape of the valley of the corrugated outer conductor to optimally contact with the valley surface of the corrugated outer conductor so as to provide a maximal clamping force to the outer conductor.

In the case that the supporting slope 15 is formed in the connector through hole 11, a locking slope 325 is formed between the outer end face 322 of the locking portion 32 of the plurality of claws 31 and the inner circumferential wall 324 of the locking portion 32. The locking slope 325 is adapted to snugly fit with the supporting slope 15. The locking slope 325 may be formed as a part of the inner circumferential wall 324 of the locking portion 32, so that the inner circumferential wall 324 is better fitted with the shape of the valley of the corrugated outer conductor.

An elastic ring 4 is sleeved on a ring enclosed by the extension portions 33 of the plurality of claws 31 of the annular elastic clip 3 on one end of the annular elastic clip 3 relative to the locking portion 32. The elastic ring 4 is suitable for generating axial elastic resilience when being extruded along the axial direction of the annular elastic clip 3. In the embodiments as shown in FIG. 1 to FIG. 5, the elastic ring 4 is a spiral spring ring. When the spiral spring ring is sleeved on the annular elastic clip 3, the spiral spring ring can also be radially and elastically expanded to a certain extent, so that the spiral spring ring can also apply a certain radial pre-tightening force to the annular elastic clip 3 via the radial elastic resilience. The elastic ring 4 can also be in other forms, for example, it can be an annular spring gasket for mainly generating the axial elastic resilience when being axially stretched.

As shown in FIG. 5, the extension portions 33 of the plurality of claws 31 of the annular elastic clip 3 extend into the central through hole 21 from the clamping end of the clamping nut 2 and are axially and slidingly fitted in the central through hole 21 of the clamping nut 2. In this way, the elastic ring 4 is located between an end wall 24 of the clamping end of the clamping nut 2 and the locking portion 32 of the annular elastic clip 3.

In one embodiment, in order to prevent that before the annular elastic clip 3 is locked relative to the clamping nut 2, its extension portion 33 drops from the central through hole 21 of the clamping nut 2 to be completely separated from the clamping nut 2, an anti-drop structure can be arranged at one end of the annular elastic clip 3 opposite to the locking portion 32. In the embodiment as shown in FIG. 3 to FIG. 5, the anti-drop structure is a snap 34 arranged on one end of the annular elastic clip 3 opposite to the locking portion 32. The snap 34 radially protrudes outward relative to the outer surface of the extension portion 33; a plurality of grooves 35 are formed on the circumferential direction of the annular elastic clip 3 to allow the portions of the snap 34 isolated by the plurality of grooves 35 to generate certain elastic deformation on the radial direction. Corresponding to the snap 34, a flange 23 is formed on the inner wall of the clamping end of the clamping nut 2. A certain axial acting force is applied to the annular elastic clip 3 by abutting against the clamping nut 2, and the snap 34 can be extruded by the flange 23 to slightly generate inward elastic deformation to slide into the central through hole 21 of the clamping nut 2 through the flange 23. When the snap 34 axially crosses the flange 23, it elastically recovers its natural state due to the elastic resilience, such that the outer diameter of the snap 34 is greater than the inner diameter of the flange 23. In this way, the snap 34 can slide axially relative to the clamping nut 2 in an axial range defined by the flange 23 of the central through hole 21 of the clamping nut 2, and meanwhile the interference fit of the flange 23 ad the snap 34 ensures that the snap 34 cannot completely depart from the central through hole 21 to be completely separated from the clamping nut 2.

As an alternative, the anti-drop structure can also be a segment of elastic clip external thread (not shown in the figure) on one end of the annular elastic clip opposite the locking portion 32 and a segment of locking nut internal thread (not shown in the figure) formed on the inner wall of the clamping end of the clamping nut 2. The elastic clip external thread can be threaded to the locking nut internal thread. When the elastic clip external thread is continuously rotated after being screwed into the locking nut internal thread, the elastic clip external thread disengages with the clamping nut internal thread to slide into the central through hole 21 of the clamping nut 2. In this way, the elastic clip external thread can also slide axially relative to the clamping nut 2 within the axial range defined by the clamping nut internal thread of the central through hole 21 of the clamping nut 2, and meanwhile the interference fit (in the ease that the two do not directionally rotate relative to each other) of the clamping nut internal thread and the elastic clip external thread during relative axial movement ensures that the elastic clip external thread cannot completely depart from the central through hole 21 to be completely separated from the clamping nut 2.

In this way, when the connector is in a state of not being connected to the cable, that is, when the connector body 1 has not been fitted to the clamping nut 2 to fix the annular elastic clip 3 to the clamping nut 2, the anti-drop structure ensures that the three single parts, namely, the annular elastic clip 3, the clamping nut 2 and the elastic ring 4 arranged therebetween, are provided for the user as an assembled single assembly without separating the parts. This not only facilitates the use of the connector by the user, so that the user does not have to assemble the three parts in the assembly by himself, but also ensures that the complete assembly can be easily provided.

Figure 6:
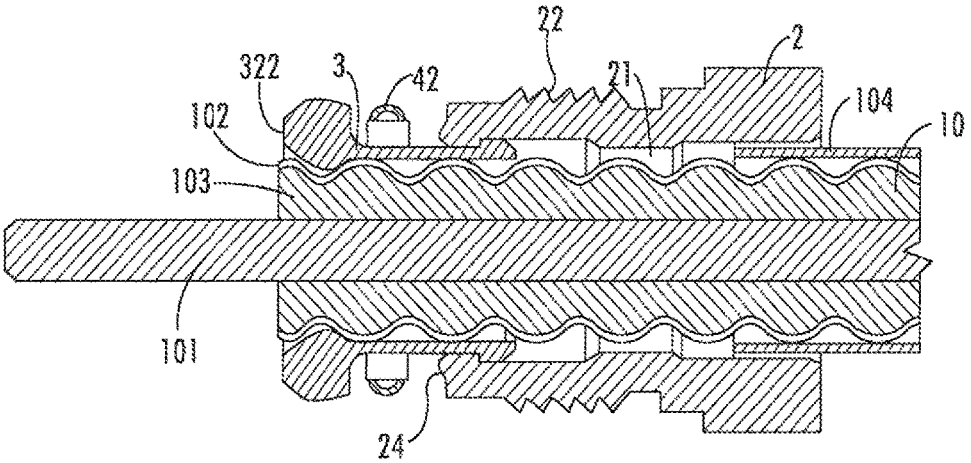
FIG. 6 is a section view illustrating the assembly of FIG. 4 on a corrugated cable.

As shown in FIG. 6, when one end of a corrugated cable 10 having a corrugated outer conductor 102 is connected to the connector according to the embodiment of the present invention to connect the corrugated cable 10 to the external port (for example, a cable joint of electrical equipment, and the other joint of a connector connected with the other cable) via the connector, at first, a part of jacket 104 at one end of the corrugated cable 10, the corrugated outer conductor 102 and an insulating layer 103 between the outer conductor 102 and an inner conductor 101 are stripped off to expose a segment of the inner conductor 101. The length of the stripped jacket 104 is greater than those of the stripped corrugated outer conductor 102 and the insulating layer 103, such that a segment of the corrugated outer conductor 102 is also exposed behind the exposed segment of inner conductor 101. Then, the end of the corrugated cable 10 is extended into the central through hole 21 of the clamping nut 2 from the cable end of the clamping nut 2 and penetrates through a space enclosed the annular elastic clip 3 connected to the clamping nut 2, and the end faces of the corrugated outer conductor 102 and the insulating layer 103 of the corrugated cable 10 are approximately aligned to the outer end face 322 of the locking portion 32 of the annular elastic clip 3, and a segment of inner conductor 101 is exposed from the annular elastic clip 3. A sufficient length of the corrugated outer conductor 102 is exposed, so that at least the part of corrugated outer conductor 102 of the corrugated cable 10 located in the annular elastic clip 3 is exposed from the jacket 104. Moreover, the inner circumferential wall 324 of the locking portion 32 of the annular elastic clip 3 is just located in the valley of the corrugated outer conductor 102.

When the corrugated cable 10 is pushed or pulled to penetrate through the annular elastic clip 3, the crest part of the corrugated outer conductor 102 may generate interference with the inner circumferential wall 324 of the locking portion 32 of the annular elastic clip 3 in the natural state. However, as the locking portion 32 of the annular elastic clip 3 is located at the tail end of the annular elastic claw 31 and has a certain radial elastic deformation ability, and the shape of the inner circumferential wall 324 of the locking portion 32 is approximately matched with the shape of the valley of the corrugated outer conductor 102, when the corrugated outer conductor 102 is applied with an axial driving force, the outer conductor 102 can apply a radial outward force component to the inner circumferential wall 324 to force the elastic claw 31 to generate radial outward elastic deformation so as to force the inner circumferential wall 324 to move outward radially. Therefore, the corrugated outer conductor 102 can overcome the blockage of the inner circumferential wall 324 of the locking portion 32 to penetrate through the annular elastic clip 3.

Figure 7:
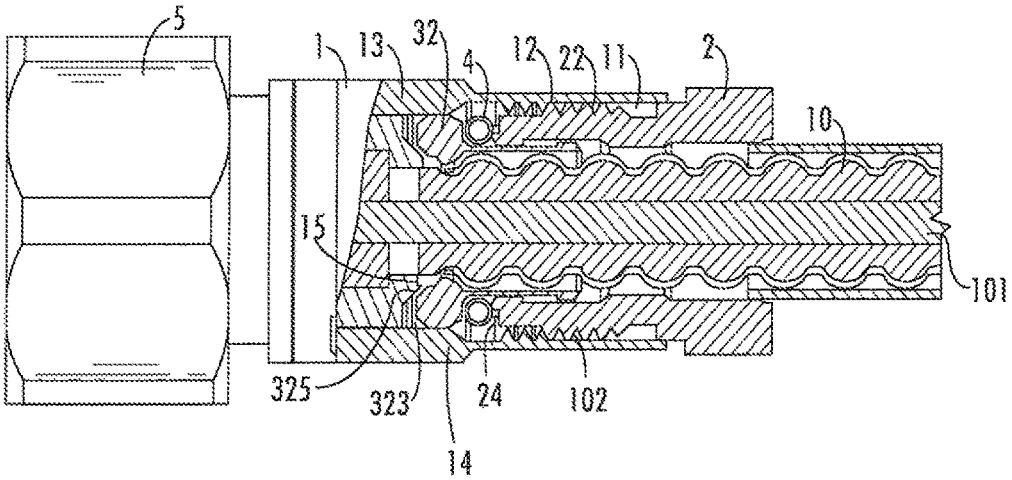
FIG. 7 is a section view illustrating the co-axial connector of FIG. 1 on the corrugated cable.

Then, as shown in FIG. 7, the matching end of the connector body 1 penetrates through the annular elastic clip 3 and is sleeved on the clamping end of the clamping nut 2, then the connector body 1 and the clamping nut 2 are driven to rotate relatively, such that the internal thread 12 of the connector body 1 and the external thread 22 of the clamping nut 2 are gradually engaged. With the engagement of the two, the clamping nut 2 gradually extends into the connector dough hole 11 of the connector body 1 and moves relative to the annular elastic clip 3, such that the distance between the end wall 24 of the clamping end of the clamping nut 2 and the locking portion 32 of the annular elastic clip 3 is gradually reduced, until the elastic ring 4 on the annular elastic clip 3 is clamped between the end wall 24 and the protruding locking portion 32 of the annular elastic clip 3, and the locking portion 32 of the annular elastic clip 3 moves along the axial direction of the connector through hole 11 to the transition slope 14, and is blocked by the transition slope 14.

When the connector body 1 and the clamping nut 2 continuously rotate relatively to further engage the internal thread 12 with the external thread 22, the elastic ring 4 is axially compressed by the end wall 24 of the clamping end of the clamping nut 2 so as to push the guide slope 323 of the locking portion 32 of the annular elastic clip 3 to move along the transition slope 14 in the connector through hole 11 and to gradually move to a position for forming the interference fit between the outer circumferential wall 321 of the locking portion 32 and the locking wall 13 in the connector body 1. In the process when the locking portion 32 of the annular elastic clip 3 moves from a position fitting with the transition slope 14 to a position fitting with the locking wall 13, the interference fit between the locking portion 32 and the inner wall of the connector body 1 is greater and greater, such that the locking wall 13 of the connector body 1 applies a greater and greater radial inward, force to the locking portion 32, resulting in radial inward elastic deformation of the claw 31 of the annular elastic clip 3; therefore, the inner circumferential wall 324 of the locking portion 32 radially compresses the valley of the corrugated outer conductor 102 of the corrugated cable 10. Under the action of the radial compression force, any axial movement trend of the corrugated cable 10 is constrained by the interference between the locking portion 32 of the annular elastic clip 3 and the crest of the corrugated outer conductor 102; therefore the corrugated cable 10 cannot move relative to the axial direction of the locking portion 32 and cannot move relative to the axial direction of the whole connector neither. Accordingly, the corrugated cable 10 is locked in the annular elastic clip 3.

In the case that the elastic ring 4 is the spiral spring ring, the spiral spring ring can also apply a radial resilience to the extension portions 33 of the claws 31 of the annular elastic clip 3. This further helps the radial inward deformation of the claws 31 of the annular elastic clip 3 to further compress the corrugated outer conductor 102 of the corrugated cable 10, so that the corrugated cable 10 is locked in the annular elastic clip 3 more firmly.

After the corrugated cable 10 is locked in the annular elastic clip 3, when the relative rotation between the connector body 1 and the clamping nut 2 is continued to further engage the internal thread 12 with the external thread 22, the annular elastic clip 3 drives the corrugated cable 10 to move axially toward the interface end of the connector body 1. In the axial movement process of the corrugated cable 10, the exposed inner conductor 101 of the corrugated cable 10 can penetrate through the overall axial length of the connector through hole 11 of the connector body 1 to extend out from the interface end of the connector body 1 so as to contact with the corresponding inner conductor in the external port to form an electrical connection.

When the supporting slope 15 is arranged in the connector through hole 11 of the connector body 1 and when the locking slope 325 is formed between the outer end face 322 of the locking portion 32 of the claw 31 of the annular elastic clip 3 and the inner circumferential wall 324 of the locking portion 32, the tail end portion (that is, the tail end portion of the corrugated outer conductor 102 that is approximately fitted with the inner circumferential wall 324 of the locking portion 32) of the corrugated outer conductor 102 of the corrugated cable 10 will axially move in the connector through hole 11 together with the annular elastic clip 3 until touching the supporting slope 15 in the connector through hole 11. The connector body 1 and the clamping nut 2 are screwed continuously to compress the tail end portion of the corrugated outer conductor 102 between the supporting slope 15 and the locking slope 325. Accordingly, the corrugated cable 10 is further locked in the connector.

When the annular elastic clip 3 and/or the supporting slope 15 are/is made of a conductive material and the connector body 1 is also made of the conductive material, the corrugated outer conductor 102 of the corrugated cable 10 is electrically connected with the connector body 1 of the connector via the annular elastic clip 3 and/or the supporting slope 15 which are/is closely contacted with the corrugated outer conductor 102. Therefore, when the interface end of the connector body 1 is connected to the external port, the electrical connection between the corrugated outer conductor 102 of the corrugated cable 10 and the external port can be achieved via the connector body 1.

After the corrugated cable 10 is locked to the connector, as the elastic ring 4 is always in a state of elastic deformation caused by axial compression by the locking portion 32 of the annular elastic clip 3 and the end wall 24 of the clamping nut 2, the elastic ring 4 always applies an axial pre-tightening force to the clamping nut 2, so that the threaded fit between the external thread 22 on the clamping nut 2 and the internal thread 12 on the connector body 1 is always pre-tightened axially, thereby preventing the possibility of looseness of the threaded fit and improving the connection reliability of the connector and the cable. The reliable connection between the cable and the connector improves the passive intermodulation performance of the connector.

After the corrugated cable 10 is connected to the connector according to the embodiment of the present invention, the connector body 1 can be locked to the external port by the interface structure of the interface end of the connector body 1 so as to achieve the respective electrical connection of the inner conductor 101 and the outer conductor 102 in the corrugated cable 10 with the corresponding conductor portions in the external port by means of the connector. For example, the connecting nut 5 on the connector body 1 can be screwed on the external thread on the external port to achieve the connection between the connector and the external port. The interface structure of the interface end of the connector body 1 can also be configured as an external thread to connect with the internal thread on the external port. Or, the interface structure of the interface end of the connector body 1 can also be configured as a slot or a snap to achieve the connection between the connector and the external port.

Preferably, the external port can also be provided by the connector according to embodiments of the present invention. That is, two connectors according to embodiments of the present invention can be provided, wherein the two connectors have basically the same structure, only the interface structures of the interface ends of the connector bodies 1 of the two connectors are different, but the interface structures are matched with each other. For example, when the interface structure of one connector is the external thread, the interface structure of the other connector is the internal thread engaged with the same. The two connectors are respectively connected to the end parts of two corrugated cables 10, and then the interface structures of the two connectors are joined together so as to achieve the electrical connection between the two corrugated cables 10.

When the corrugated cable 10 needs to be detached from the connector, the threaded fit between the connector body 1 and the clamping nut 2 is directly unscrewed to remove the radial clamping force applied by the connector body 1 to the annular elastic clip 3 and the corrugated cable 10, and thus the corrugated cable 10 can be easily pulled out from the connector.

As the radial clamping force of the annular elastic clip is mainly from the interference fit between the connector body 1 and the annular elastic clip 3 rather than the own elasticity of the annular elastic clip 3, even if the connectors are numerously detached to reduce the own elasticity of the annular elastic clip 3, enough radial clamping force can still be applied to the annular elastic clip 3 by threaded connection driving to reliably lock the corrugated cable 10.

Although it has been described in the above embodiments that the corrugated cable co-axial connector according to the present invention is used as a radio frequency device connector for connecting the corrugated cable to a radio frequency device, it should be understood that the corrugated cable co-axial connector according to the present invention may also be used for connecting the corrugated cable to any external port, and the corrugated cable co-axial connector according to the present invention is also suitable for connecting with any cable having the corrugated outer conductor whether or not it has an inner conductor and a jacket.

The specification of the present invention has been presented for the purposes of illustration and description, but is not intended to be exhaustive or limited to the forms disclosed. Those skilled in the art may think of many modifications and variations. Thus, the embodiments were chosen and described in order to best explain the principles of the present invention and the practical application and to enable others in those skilled in the art to understand the following contents, that is, all the modifications and substitutions made without departing from the spirit of the present invention shall fall within—the protection scope of the present invention defined by the appended claims.

The invention claimed is:

1. A corrugated cable co-axial connector, comprising:

a connector body, having a connector through hole, having an interface end and a matching end in an axial direction of the connector through hole which are opposite to each other, and having an internal thread at the matching end;

a clamping nut, having a central through hole, having a cable end and a clamping end in an axial direction of the central through hole which are opposite each other, and having an external thread at the clamping end;

an annular elastic clip which is, at the clamping end of the clamping nut, axially slidingly fitted into the central through hole of the clamping nut; and a resilient ring circumscribing the annular elastic clip and located between the clamping end of the clamping nut and the annular elastic clip;

wherein, the clamping nut is configured in a way that when a corrugated cable having a corrugated outer conductor is received in the central through hole of the clamping nut, the connector body applies at least a radial inward force to the annular elastic clip by the engagement of the external thread of the clamping nut and the internal thread of the connector body, to lock the corrugated cable in the annular elastic clip.

2. The corrugated cable co-axial connector according to claim 1, wherein the resilient ring is configured in a way that when the clamping nut is tightly locked with the connector body with the thread fit, the resilient ring applies at least an axial pre-tightening force to the clamping nut.

3. The corrugated cable co-axial connector according to claim 2, wherein the resilient ring is configured to further apply a radial pre-tightening force to the annular elastic clip.

4. The corrugated cable co-axial connector according to claim 1, wherein the resilient ring is a spiral spring ring or annular spring gasket.

5. The corrugated cable co-axial connector according to claim 1, wherein a locking wall is formed in an inner wall of the connector through hole of the connector body; the annular elastic clip includes a plurality of claws distributed around its central axis, each of the plurality of claws comprises a locking portion and an extension portion, the extension portions of the plurality of claws are connected to one another at one end, and the other ends of respective extension portions form the locking portions separated from one another; wherein an outer diameter of a ring formed by an outer circumferential wall of the locking portions of the plurality of claws is greater than a diameter of the locking wall in the connector body so that when the clamping nut is tightly locked with the connector body with the thread fit, the locking portions of the plurality of claws interference-fit with the locking wall in the connector body and is forced to generate a radial inward elastic deformation.

6. The corrugated cable co-axial connector according to claim 5, wherein on an inner wall of the connector through hole of the connector body is provided a transition slope between the internal thread and the locking wall, and a guide slope is provided between an outer end face of the locking portion of the plurality of claws and the outer circumferential wall of the locking portion of the plurality of claws, the guide slope is adapted to fit with the transition slope to guide the locking portion to interference fit with the locking wall.

7. The corrugated cable co-axial connector according to claim 5, wherein the resilient ring is sleeved around the extension portion of the claw of the annular elastic clip, and is located between the clamping end of the clamping nut and the locking portion of the claw.

8. The corrugated cable co-axial connector according to claim 7, wherein the extension portion of the plurality of claws slidingly extends from the clamping end of the clamping nut into the central through hole of the clamping nut, and an inner diameter of a ring formed by the extension portions of the plurality of claws is configured to allow the corrugated outer conductor of the corrugated cable to extend into the ring formed by the extension portions; and an inner diameter of a ring formed by an inner circumferential wall of the locking portion is smaller than an inner diameter of the ring formed by the extension portions so that the inner circumferential wall of the locking portion is adapted to fit with a valley of the corrugated outer conductor of the corrugated cable.

9. The corrugated cable co-axial connector according to claim 8, wherein a locking slope is formed between the outer end face of the locking portion of the plurality of claws and the inner circumferential wall of the locking portion of the plurality of claws, and a supporting slope is formed in the connector body; wherein when the clamping nut is locked with the connector body with thread fit, a distal end of the corrugated outer conductor of the corrugated cable extending into the annular elastic clip is clamped between the locking slope and the supporting slope.

10. The corrugated cable co-axial connector according to claim 5, wherein a snap is provided at an end of the annular elastic clip opposite to the locking portion, a flange is formed on an inner wall of the clamping end of the clamping nut, and the snap is adapted to be pressed by the flange to elastically deform to slide into the central through hole of the clamping nut.

11. The corrugated cable co-axial connector according to claim 5, wherein an elastic clip external thread is provided at an end of the annular elastic clip opposite to the locking portion, and a clamping nut internal thread is formed on an inner wall of the clamping end of the clamping nut; the elastic clip external thread is configured such that by continuing to rotate the elastic clip external thread after being threaded into the clamping nut internal thread, the elastic clip external thread disengages with the clamping nut internal thread to slide into the central through hole of the clamping nut.

12. The corrugated cable co-axial connector according to claim 1, wherein the annular elastic clip is made of hard plastic or brass material.

13. The corrugated cable co-axial connector according to claim 1, wherein an interface end of the connector body has a connecting nut to lock the connector body to an external port.

14. The corrugated cable co-axial connector according to claim 1, wherein the connector through hole of the connector body is configured to allow an inner conductor of the corrugated cable to extend in the connector through hole to the interface end.

15. A corrugated cable co-axial connector, comprising:

a connector body, having a connector through hole, having an interface end and a matching end in an axial direction of the connector through hole which are opposite to each other, and having an internal thread at the matching end;

a clamping nut, having a central through hole, having a cable end and a clamping end in an axial direction of the central through hole which are opposite each other, and having an external thread at the clamping end;

an annular elastic clip which is, at the clamping end of the clamping nut, axially slidingly fitted into the central through hole of the clamping nut; and a resilient ring sleeved around the annular elastic clip and located between the clamping end of the clamping nut and the annular elastic clip;

wherein, the clamping nut is configured in a way that when a corrugated cable having a corrugated outer conductor is received in the central through hole of the clamping nut, the connector body applies at least a radial inward force to the annular elastic clip by the engagement of the external thread of the clamping nut and the internal thread of the connector body, to lock the corrugated cable in the annular elastic clip, wherein a locking wall is formed in an inner wall of the connector through hole of the connector body; the annular elastic clip includes a plurality of claws distributed around its central axis, each of the plurality of claws comprises a locking portion and an extension portion, the extension portions of the plurality of claws are connected to one another at one end, and the other ends of respective extension portions form the locking portions separated from one another; wherein an outer diameter of a ring formed by an outer circumferential wall of the locking portions of the plurality of claws is greater than a diameter of the locking wall in the connector body so that when the clamping nut is tightly locked with the connector body with the thread fit, the locking portions of the plurality of claws interference-fit with the locking wall in the connector body and is forced to generate a radial inward elastic deformation.

16. A corrugated cable co-axial connector assembly, comprising:

a corrugated cable having a corrugated outer conductor; and a co-axial connector, the co-axial connector comprising:

a connector body, having a connector through hole, an interface end and a mating end in an axial direction of the connector through hole which are opposite to each other, and an internal thread at the mating end;

a clamping nut, having a central through hole, a cable end and a clamping end in an axial direction of the central through hole which are opposite each other, and an external thread at the clamping end;

an annular elastic clip axially slidingly fitted into the central through hole of the clamping nut, the annular elastic clip comprising a locking portion at an end opposite to the central through hole of the clamping nut; and a resilient ring sleeved around the annular elastic clip and located between the clamping end of the clamping nut and the annular elastic clip;

wherein the external thread of the clamping nut is configured to engage the internal thread of the connector body when the corrugated cable is received in the central through hole of the clamping nut, and the connector body applies at least a radial inward force to the annular elastic clip forcing the locking portion of the annular elastic clip to engage a valley in a corrugation of the outer conductor of the corrugated cable.

* * * * *